United States Patent [19]

Fujimoto et al.

[11] Patent Number: 4,847,192

[45] Date of Patent: Jul. 11, 1989

[54] APPARATUS FOR FINELY RAISING AND LOWERING A WICK OF A KEROSENE HEATER

[75] Inventors: Masayuki Fujimoto, Nara; Muneo Tao, Yamatokoriyama; Kuniaki Uchida, Kashihara, all of Japan

[73] Assignee: Matsushita Electric Industrial Co., Ltd., Japan

[21] Appl. No.: 191,130

[22] Filed: May 6, 1988

[30] Foreign Application Priority Data

| | | | |
|---|---|---|---|
| May 12, 1987 | [JP] | Japan | 62-115030 |
| May 22, 1987 | [JP] | Japan | 62-126277 |
| May 22, 1987 | [JP] | Japan | 62-126278 |
| Aug. 5, 1987 | [JP] | Japan | 62-195955 |
| Aug. 5, 1987 | [JP] | Japan | 62-195956 |
| Sep. 7, 1987 | [JP] | Japan | 62-223460 |
| Nov. 9, 1987 | [JP] | Japan | 62-282421 |

[51] Int. Cl.[4] ..... F23N 5/24

[52] U.S. Cl. ..... 431/88; 431/304

[58] Field of Search ..... 431/88, 301, 304, 307; 126/96

[56] References Cited

U.S. PATENT DOCUMENTS 4,726,762 2/1988 Nakamura et al. ..... 431/88

FOREIGN PATENT DOCUMENTS

| | | | |
|---|---|---|---|
| 0175712 | 10/1983 | Japan | 431/301 |
| 0074411 | 4/1984 | Japan | 431/304 |
| 0002808 | 1/1985 | Japan | 431/304 |

*Primary Examiner*—Margaret A. Focarino

*Attorney, Agent, or Firm*—Lowe, Price, LeBlanc, Becker & Shur

[57] ABSTRACT

In a kerosene heater in which combustion is effected by means of a wick (3), a wick raising and lowering mechanism (5) for raising and lowering the wick (3) and a fine-regulatable wick raising and lowering mechanism (20) for finely controlling the combustion rate of the wick (3) are provided. The fine-regulatable wick raising and lowering mechanism (20) generally includes a rack (23), a wick-raising pinion (32), a wick-lowering pinion (34), a first manually operable member (27) for driving the wick-raising pinion (32), and a second manually operable member (28) for driving the wick-lowering pinion (34). The combustion rate can be finely, easily, and safely regulated by means of an operation between the rack (23) and the wick-raising and lowering pinions (32, 34).

12 Claims, 11 Drawing Sheets

APPARATUS FOR FINELY RAISING AND LOWERING A WICK OF A KEROSENE HEATER

BACKGROUND OF THE INVENTION

1. Field of the Invention

This invention relates generally to a kerosene heater in which combustion is effected by means of a wick, and particularly to an apparatus for finely raising and lowering the wick used in the kerosene heater.

2. Prior Art

As is well known in the art, a conventional kerosene heater generally comprises a wick, a manually operable lever, a fuel tank, and a combustion pipe. A manually operable lever is coupled to the wick by means of a pin, and upward and downward movement of the manually operable lever by a user thereby produces corresponding lowering and raising of the wick. Recently, it is required that such type of kerosene heater be miniaturized, thereby decreasing the length of the manually operable lever. In addition, since there is no regulating device for finely controlling the upward and downward movement of the wick, a user roughly regulates the movement of the wick. Thus, in the conventional wick raising and lowering apparatus, there is a disadvantage that the wick is difficult to adjust to finely regulate the rate of combustion.

SUMMARY OF THE INVENTION

The present invention has been developed in order to remove the above-described drawbacks inherent to the conventional apparatus for raising and lowering a wick of a kerosene heater.

It is, therefore, an object of the present invention to provide a new and useful kerosene heater raising and lowering apparatus having a fine-regulatable wick raising and lowering mechanism for finely regulating the rate of combustion of the wick.

It is another object of the invention to provide a kerosene heater raising and lowering apparatus having a fine-regulatable wick raising and lowering mechanism in which a pinion is engaged with a rack only when the fine-regulatable wick raising and lowering mechanism is operated by a user.

It is a further object of the invention to provide a kerosene heater raising and lowering apparatus having a fine-regulatable wick raising and lowering mechanism in which a pinion is easily slipped from a rack in the event of accidental movement thereof to safely extinguish a wick.

It is a still further object of the invention to provide a kerosene heater raising and lowering apparatus having a fine-regulatable wick raising and lowering mechanism operating only when a wick is normally combusted.

It is another object of the invention to provide a kerosene heater raising and lowering apparatus having a fine-regulatable wick raising and lowering mechanism in which the wick-raising operational force is equal to the wick-lowering operational force.

In accordance with the present invention there is provided an apparatus for raising and lowering a wick of a kerosene heater, comprising: a wick raising and lowering means having means for supporting the wick and a manually operable wick raising and lowering lever for raising and lowering the means for supporting the wick; and a fine-regulatable wick raising and lowering means for finely controlling an angular position of the wick raising and lowering lever, including: a rack provided to the manually operable wick raising and lowering lever; a wick-raising pinion pivotally provided to a first slidable member so that a portion of the wick-raising pinion is engageable the rack; a wick-lowering pinion second slidable member so that a portion of the wick-lowering pinion is engageable to the rack; a first manually operable member for driving the first slidable member when moved in one direction whereby the wick-raising pinion is engaged with the rack to render the wick movably upward; and a second manually operable member for driving the second slidable member when moved in one direction whereby the wick-lowering pinion is engaged with the rack to render the wick movably downward.

In accordance with the present invention there is also provided an apparatus for raising and lowering a wick of a kerosene heater, comprising: a wick raising and lowering means having means for supporting the wick and a manually operable wick raising and lowering lever for raising and lowering the means for supporting the wick; and a fine-regulatable wick raising and lowering means for finely controlling an angular position of the wick raising and lowering lever, including: a rack provided to the manually operable wick raising and lowering lever; a wick-raising pinion pivotally provided to a first slidable member so that a portion of the wick-raising pinion is engageable to the rack; a wick-lowering pinion second slidable member so that a portion of the wick-lowering pinion is engageable to the rack; and a manually operable member for driving the first slidable member when moved in one direction whereby the wick-raising pinion is engaged with the rack to render the wick movably upward and for driving the second slidable member when moved in the opposite direction whereby the wick-lowering pinion is engaged with the rack to render the wick movably downward.

In accordance with the present invention there is further provided an apparatus for raising and lowering a wick of a kerosene heater, comprising: a wick raising and lowering means having means for supporting the wick and a manually operable wick raising and lowering lever for raising and lowering the means for supporting the wick; and a fine-regulatable wick raising and lowering means for finely controlling an angular position of the wick raising and lowering lever, including: an auxiliary lever member adjustably provided to the manually operable wick raising and lowering lever; a rack provided to the auxiliary lever member; a wick-raising pinion pivotally provided to a first slidable member so that a portion of the wick-raising pinion is engageable to the rack; a wick-lowering pinion second slidable member so that a portion of the wick-lowering pinion is engageable to the rack; a first manually operable member for driving the first slidable member when moved in one direction whereby the wick-raising pinion is engaged with the rack to render the wick movably upward; and a second manually operable member for driving the second slidable member when moved in one direction whereby the wick-lowering pinion is engaged with the rack to render the wick movably downward.

In accordance with the present invention there is still further provided an apparatus for raising and lowering a wick of a kerosene heater, comprising: a wick raising and lowering means having means for supporting the wick and a manually operable wick raising and lowering lever for raising and lowering the means for supporting the wick; and a fine-regulatable wick raising and lowering means for finely controlling an angular position of the wick raising and lowering lever, including: an auxiliary lever member adjustably provided to the manually operable wick raising and lowering lever; a rack provided to the auxiliary lever; a wick-raising pinion pivotally provided to a first slidable member so that a portion of the wick-raising pinion is engageable to the rack; a wick-lowering pinion second slidable member so that a portion of the wick-lowering pinion is engageable to the rack; and a manually operable member for driving the first slidable member when moved in one direction whereby the wick-raising pinion is engaged with the rack to render the wick movably upward and for driving the second slidable member when moved in opposite direction whereby the wick-lowering pinion is engaged with the rack to render the wick movably downward.

BRIEF DESCRIPTION OF THE DRAWINGS

The object and features of the present invention will become more readily apparent from the following detailed description of the preferred embodiments taken in conjunction with the accompanying drawings in which.

The same or corresponding elements and parts are designated at like reference numerals throughout the drawings.

DETAILED DESCRIPTION OF THE INVENTION

Figure 20:
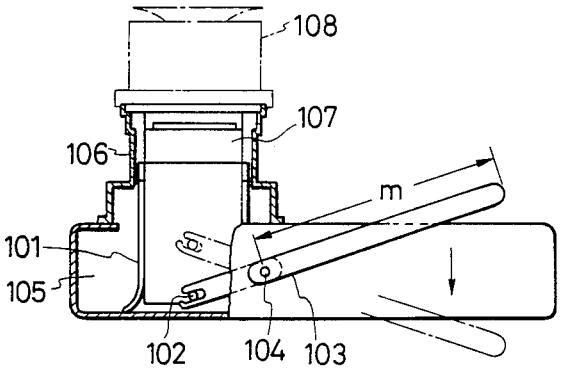
FIG. 20 PRIOR ART
FIG. 20 is a cross-sectional view in elevation of a prior art kerosene heater.

Prior to describing the preferred embodiments of the present invention, the above-mentioned conventional kerosene heater will be described for a better understanding of the present invention. FIG. 20 shows the basic configuration of a conventional kerosene heater comprising a wick 101, a pin 102, a manually operable lever 103, a pivot 104, a fuel tank 105, a wick outer pipe 106, a wick guidance pipe 107, and a combustion pipe 108. A manually operable lever 103 is coupled to the wick 101 by means of the pin 102, and upward and downward movement of the manually operable lever 103 by a user thereby produces corresponding lowering and raising of the wick 101. Recently, it is required that such type of the kerosene heater be miniaturized, thereby decreasing a length m of the manually operable lever 103. In addition, since there is no regulating device for finely controlling the upward and downward movement of the wick 101, a user roughly regulates the movement of the wick 101. Thus, in the conventional wick raising and lowering apparatus, there is a disadvantage that the wick 101 is difficult to finely regulate the rate of combustion.

Figure 1:
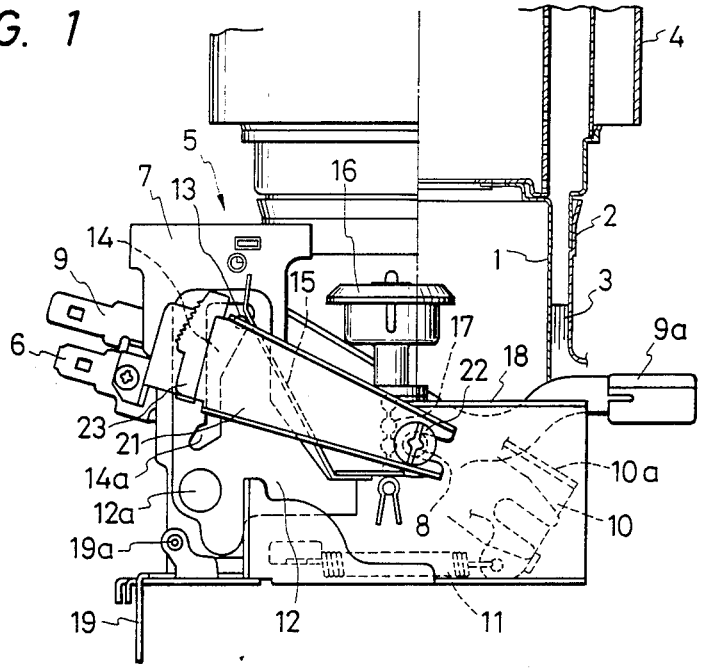
FIG. 1 is a side elevational view of an apparatus for raising and lowering a wick of a kerosene heater showing the condition prior to igniting the wick according to a first embodiment of the present invention.
Figure 2:
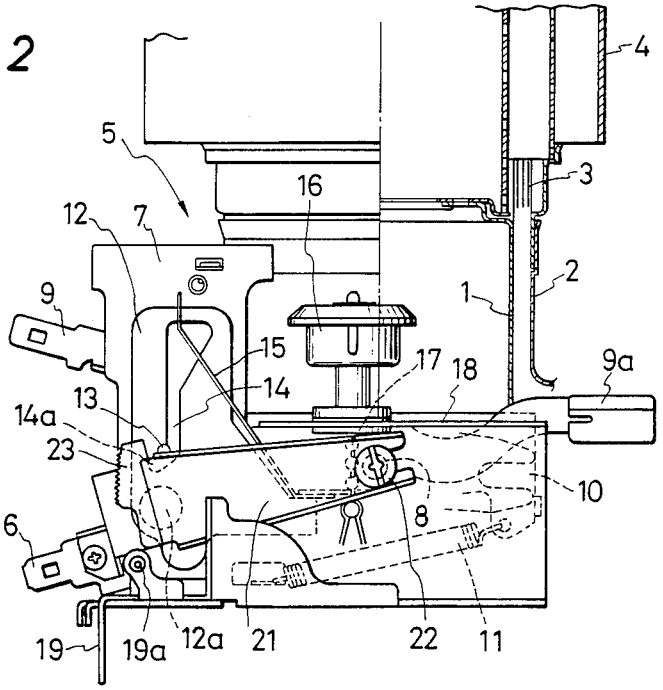
FIG. 2 is a side elevational view of the apparatus for raising and lowering the wick according to the first embodiment showing the condition following igniting of the wick.

A first embodiment of an apparatus for raising and lowering a wick of a kerosene heater according to the present invention will be described hereinbelow with reference to FIGS. 1 through 11. FIGS. 1 and 2 respectively illustrate a side elevational view of an apparatus for raising and lowering a wick of a kerosene heater respectively showing the condition prior to igniting the wick and the condition following igniting of the wick. As shown in FIGS. 1 and 2, the kerosene heater generally comprises a wick guidance pipe 1, a wick outer pipe 2 which is provided around the wick guidance pipe 1 at an interval, a wick 3 which is provided between the wick guidance pipe 1 and the wick outer pipe 2, a combustion tube 4 in which vaporized fuel from the wick 3 is combusted, a kerosene heater wick raising and lowering mechanism 5, and a combustion-rate displaying mechanism 41 (see also FIG. 8) described hereinafter. The wick 3 is supported by a wick supporting pipe (not shown), and is moved upward and downward by means of the kerosene heater wick raising and lowering mechanism 5.

The kerosene heater wick raising and lowering mechanism 5 generally includes a manually operable wick raising and lowering lever 6 which is connected with the wick supporting pipe, a wick raising and lowering baseplate 7, a pin 8, an igniting lever 9, a wick raising and lowering plate 10, a spring 11, a lock plate 12, a lock pin 13, a leaf spring 15, a weight 16, a chain 17, and an emergency extinguishing pushbutton 19.

In the kerosene heater wick raising and lowering mechanism 5, the manually operable wick raising and lowering lever 6 is provided so as to pivot on the wick raising and lowering baseplate 7 by means of the pin 8, and the igniting lever 9 is also pivoted on the wick raising and lowering baseplate 7 by means of the pin 8. An ignition device (not shown) is operated by an end portion 9*a* of the ignition lever 9, so that the wick 3 is ignited. After this, the ignition lever 9 is automatically returned to an original position. The wick raising and lowering plate 10 is coupled to the manually operable wick raising and lowering lever 6 by means of a coupling arm 10*a* of the wick raising and lowering plate 10 when the manually operable wick raising and lowering lever 6 is lowered by a user. The spring 11 urges the wick raising and lowering plate 10 in the downward direction of the wick, and is connected to one end of the wick raising and lowering plate 10 with the wick raising and lowering baseplate 7. The lock plate 12 is rotatably provided to the wick raising and lowering baseplate 7 by a pin 12*a*, and has a slit 14 through which the lock pin 13 fixed to the wick raising and lowering plate 10 is passed so that the lock pin 13 is held at a stopper portion 14*a* as an end portion of the slit 14. More specifically, when the wick raising and lowering plate 10 rotates in the direction in which the lock pin 13 is held at the end portion 14*a* by lowering the manually operable wick raising and lowering lever 6 (i.e. corresponding to a upward direction of the wick 3), the wick raising and lowering plate 10 is locked at this time in spite of the force of the urged spring 11.

The leaf spring 15 is attached to the lock plate 12, and the weight 16 is coupled to the leaf spring 15 through the chain 17 so as to be used to extinguish the kerosene heater in the event of accidental movement, e.g. due to an earthquake, etc. The weight 16 is supported on a cradle 18 wich is attached to the wick raising and lowering baseplate 7. When an earthquake occurs of sufficient magnitude that the weight 16 is displaced and falls, a force is thereby applied through the chain 17 which acts to bend the leaf spring 15 and hence rotate the lockplate 12. As a result, the lock pin 13 is moved out of the stopper portion 14*a* of the slit 14 whereby the wick raising and lowering plate 10 is swung in the direction in which the wick 3 is lowered by the spring 11. When occurring the above operation occurs, the wick 3 is lowered, the lock pin 13 is returned to the uppermost position, and presses against the leaf spring 15 so that the weight 16 is suspended by the chain 17 thereby returning to the original position thereof. The emergency extinguishing pushbutton 19 is pivoted on the manually operable wick raising and lowering baseplate 7 by means of a pin 19*a*, and operates by rotating the lock plate 12 similar to the above-described operation when the emergency extinguishing pushbutton is pushed by a user. In this embodiment, it is to be noted that a sub-lever 21 is fixed to the manually operable wick raising and lowering lever 6 as one body in order to finely control the angular position of the manually operable lever 6 by means of a fine-regulatable wick raising and lowering mechanism 20 as shown in the following description.

Figure 3:
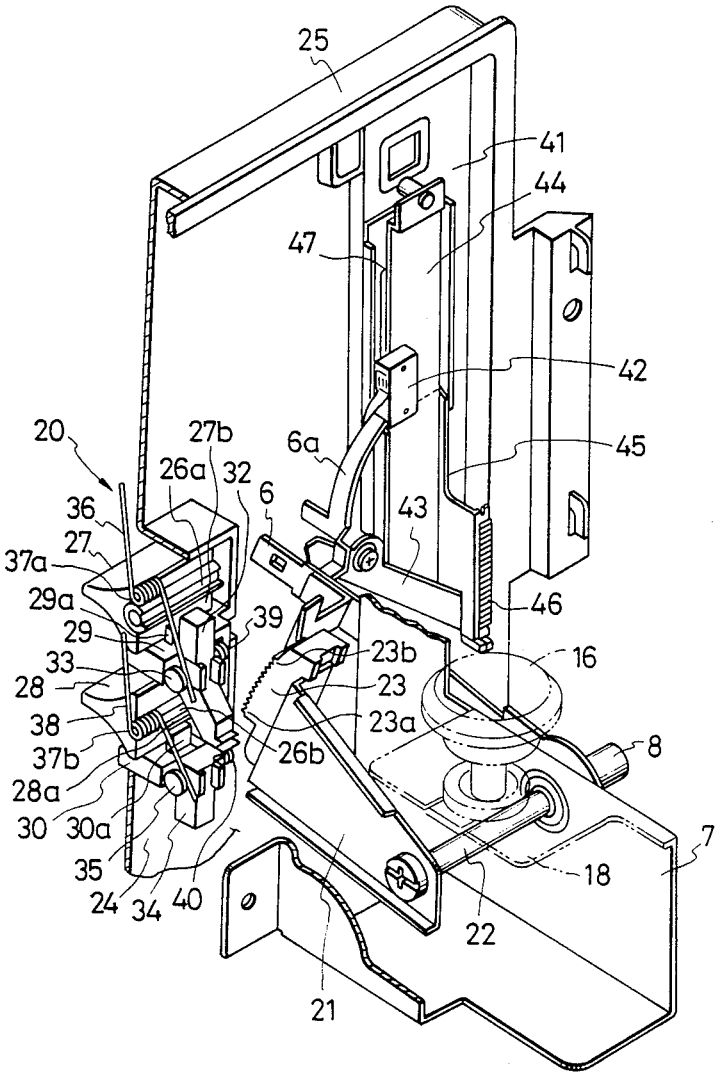
FIG. 3 is an oblique view of the apparatus for raising and lowering the wick according to the first embodiment.
Figure 4:
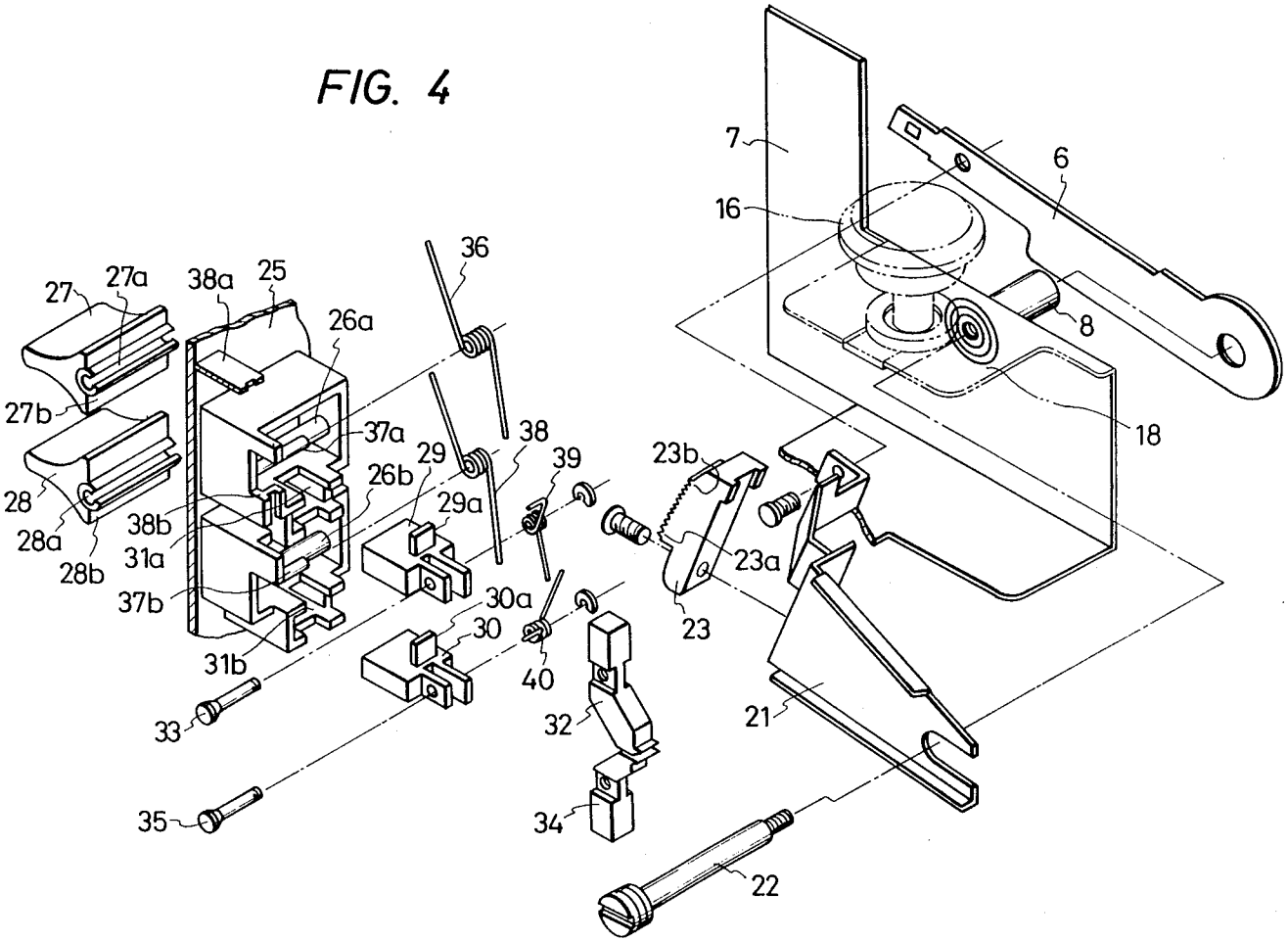
FIG. 4 is an exploded oblique view of essential components of the apparatus for raising and lowering the wick according to the first embodiment.

The structure of the fine-regulatable wick raising and lowering mechanism 20 according to the first embodiment will be described with reference to FIGS. 3 and 4 hereinbelow. The fine-regulatable wick raising and lowering mechanism generally comprises the lever member having the sub-lever 21 fixed to the manually operable wick raising and lowering lever 6, a rack 23 provided to the lever member, a first slidable member 29 having a projection 29*a* and a second slidable member 30 having a projection 30*a*, a wick-raising pinion 32 which is pivotally provided to the first slidable member 29, a wick-lowering pinion 34 which is pivotally provided to the second slidable member 30, a first manually operable member 27, and a second manually operable member 28. The sub-lever 21 is rotatably provided to the manually operable wick raising and lowering baseplate 7 by means of a sub-lever supporting shaft 22 having the same axis as the pin 8, and is rotated with the rotational movement of the manually operable wick raising and lowering lever 6. The rack 23 is attached to the sub-lever 21.

The manually operable wick raising and lowering baseplate 7 is fixed to a base body 25 having a supporting shaft 26*a* for supporting the first manually operable member 27, a supporting member 26*b* for supporting the second manually operable member 28, a supporting chamber 31*a* for slidably accommodating the first slidable member 29, a supporting chamber 31*b* for slidably accommodating the member 30, a spring supporting pole 37*a*, a spring supporting shaft 37*b*, a spring bearing portion 38*a*, and a spring bearing portion 38*b*. The first manually operable member 27 has a bearing portion 27*a* which is to be rotatably connected with the supporting shaft 26*a*, and the second manually operable member 28 has a bearing portion 28*a* which is to be rotatably connected with the supporting shaft 26*b*. The wick-raising pinion 32 is pivotally provided to the first slidable member 29 by a shaft 33, and the wick-lowering pinion 34 is pivotally provided to the second slidable member 29 by a shaft 35.

The first manually operable member 27 is always biased in the opposite direction to the rack 23 by a slidable member returning spring 36 which is provided to the spring supporting shaft 37*a*, and the second manually operable member 28 is also biased in the opposite direction to the rack 23 by a slidable member returning spring 38 which is provided to the spring supporting shaft 37*b*. The spring bearing portion 38*a* receives one end of the slidable member returning spring 36, and the shaft 33 receives the other end of the same. The spring bearing portion 38*b* receives one end of the slidable member returning spring 38, and the shaft 35 receives the other end of the same. The pinion 32 is always urged in the opposite direction to the rack 23 by a pinion returning spring 39 which is provided to the shaft 33, and the wick-lowering pinion 34 is always urged in the opposite direction to the rack 23 by a pinion returning spring 40 which is provided to the shaft 35. The above-mentioned elements, i.e. the wick-raising and lowering pinions 32 and 34, the sliding member returning springs 36 and 38, the first and second slidable members 29 and 30, the shafts 33 and 35, the pinion returning springs 39 and 40, and rack 23, are operated as a clutch mechanism 24.

Figure 5:
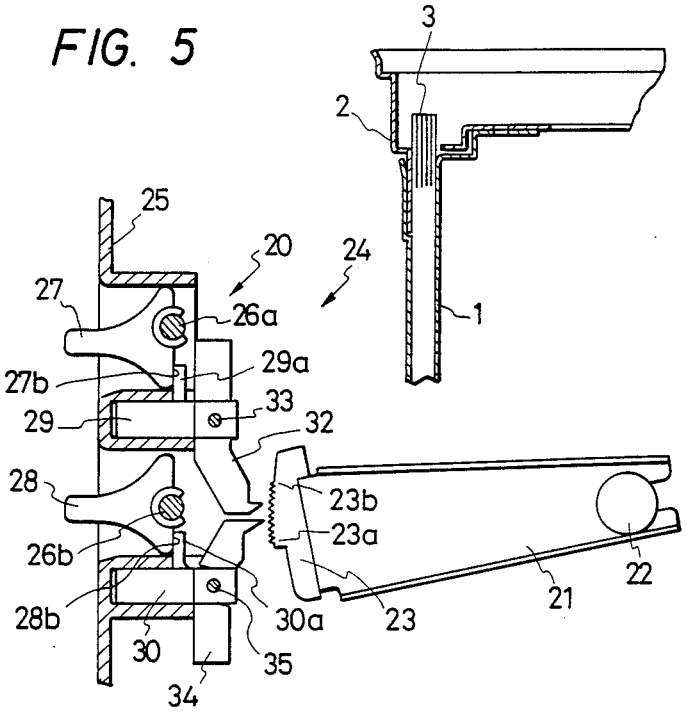
FIG. 5 is a side elevational and partially sectional view of a fine-regulatable wick raising and lowering mechanism according to the first embodiment showing the condition prior to operating the fine-regulatable wick raising and lowering mechanism.

Next, the operation of the fine-regulatable wick raising and lowering mechanism 20 will be described with reference to FIGS. 5 through 7 hereinbelow. When the manually operable wick raising and lowering lever 6 is lowered by a user, since the sub-lever 21 is lowered together with the manually operable wick raising and lowering lever 6, the rack 23 is faced the wick-raising and lowering pinions 32 and 34. At this time, the position of the rack 23 is kept to this position because the lock pin 13 is held to the stopper portion 14*a* of the slit 14. FIG. 5 is a side elevational and partially sectional view of the fine-regulatable wick raising and lowering mechanism 20 showing the condition prior to operating the fine-regulatable wick raising and lowering mechanism 20. When the wick 3 is set to a combusting position, the rack 23 faces the wick-raising pinion 32 and the wick-lowering pinion 34.

Figure 7:
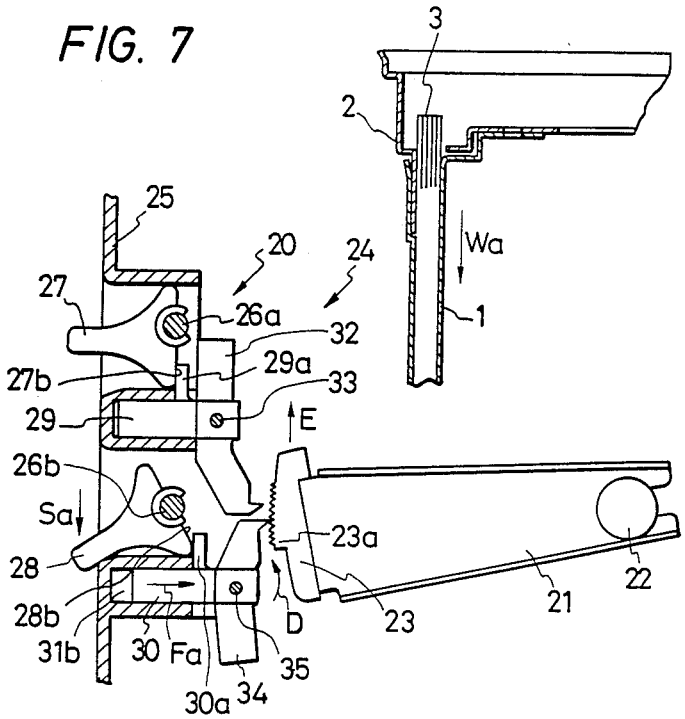
FIG. 7 is a side elevational and partially sectional view of the fine-regulatable wick raising and lowering mechanism according to the first embodiment showing the condition in which the wick is lowered.

As shown in FIG. 7, when the combustion rate is decreased, the second manually operable member 28 is driven in the direction to an arrow Sa, and a hitting portion 28*b* thereof forces the projection 30*a* of the second slidable member 30. Therefore, the second slidable member 30 is slid in the direction to an arrow Fa, and the wick-lowering pinion 34 provided to the second slidable member 30, is engaged with the rack 23 at this time. Then, the wick-lowering pinion 34 is rotated in the direction to an arrow D, and the rack 23 is raised in the direction to an arrow E. As a result, the wick 3 indirectly connected to the manually operable wick raising and lowering lever 6, is lowered as shown by an arrow Wa. Here, if the second manually operable member 28 is pushed one time in the direction of the arrow Sa, the rack 23 is driven in the direction to the arrow E by the second manually operable member 28 by one pitch of the teeth of the rack 23. After the rack 23 is raised by one pitch thereof, the wick-lowering pinion 34 is returned to an original position as shown in FIG. 5 by the biased force of the slidable member returning spring 38 (see also FIGS. 3 and 4). Therefore, the wick-lowering pinion 34 is also returned an original position, and is separated from the rack 23.

Figure 6:
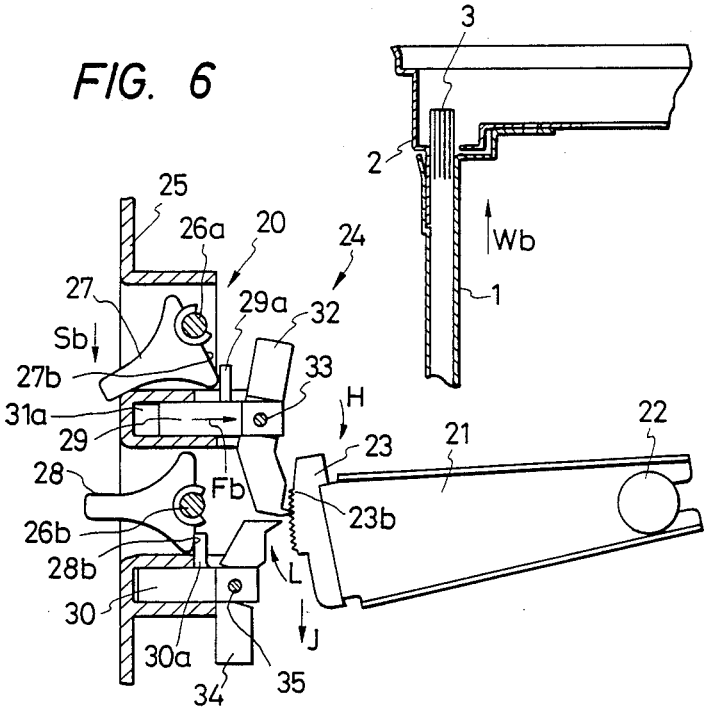
FIG. 6 is a side elevational and partially sectional view of the fine-regulatable wick raising and lowering mechanism according to the first embodiment showing the condition in which the wick is raised.

As shown in FIG. 6, when the combustion rate is increased, the first manually operable member 27 is driven in the direction to an arrow Sb, and a hitting portion 27*b* thereof forces the projection 29*a* of the first slidable member 29. Therefore, the first slidable member 29 is slid in the direction to an arrow Fb, and the wick-raising pinion 32 provided to the first slidable member 29 is engaged with the rack 23 at this time. Then, the wick-raising pinion 32 is rotated in the direction to an arrow H, and the rack 23 is lowered in the direction to an arrow J. As a result, the wick 3 is raised in the direction to an arrow Wb. Here, if the first manually operable member 27 is pushed by one time in the direction of the arrow Sb, the rack 23 is driven in the direction to the arrow J by the first manually operable member 27 by one pitch of the teeth of the rack 23. After the rack 23 is lowered by one pitch thereof, the wick-raising pinion 32 is returned to an original position as shown in FIG. 5 by the biased force of the slidable member returning spring 36 (see also FIGS. 3 and 4). Therefore, the wick-raising pinion 32 is also returned thereto, and is separated from the rack 23.

The combustion-rate displaying mechanism 41 will be described with reference to FIGS. 3 and 8 hereinbelow. In FIG. 3, combustion-rate displaying mechanism 41 generally comprises an operating arm 6*a* fixed to the manually operable wick raising and lowering lever 6, a displaying lever 43 rotatably provided on the base body 25, a guide plate 44, a displaying member 45 which is slidably movable between the base body 25 and the guide plate 44, a spring 46 connecting the base body 25 with the displaying member 45, and a displaying window 47 for recognizing the movement of the displaying member 45. The operating arm 6*a* switches a microswitch 42 to operate a electric absorption device (not shown) for absorbing a gas generated after the extinguishment of the kerosene heater, for example. One end of the displaying lever 43 is hit to the lower portion of the operating arm 6*a*, and the other end of the displaying lever 43 is hit to the lower position of the displaying member 45. The spring 46 urges the displaying member 45 in the downward direction.

Figure 8:
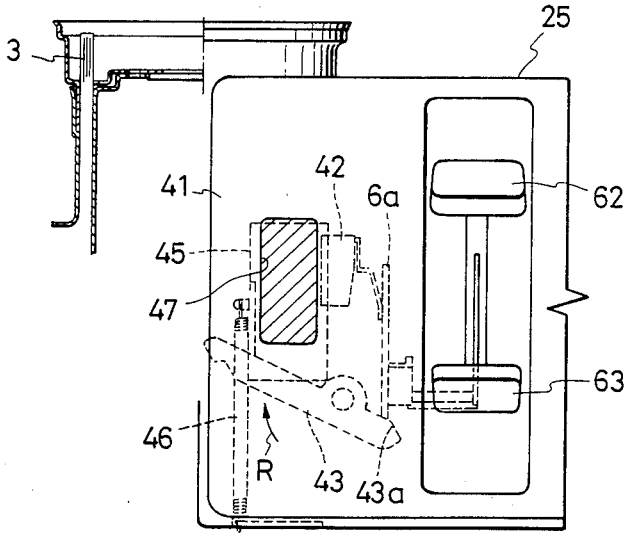
FIG. 8 is an elevational view showing a relation between a displaying apparatus and the apparatus for raising and lowering the wick for better understanding of the present invention.

As shown in FIG. 8, when the wick 3 is raised, the opration arm 6*a* is hit to a hitting portion 43*a* of the displaying lever 43, and the displaying lever is rotated in the direction to an arrow R thereby raising the displaying member 45 in spite of the urged force of the spring 46. Thus, since the manually operable wick raising and lowering lever 6 is indirectly connected with a displaying member 45 of the combustion-rate displaying mechanism 41 for displaying a fuel consumption rate, the combustion rate is displayed in accordance with the movement of the wick 3.

Figure 9:
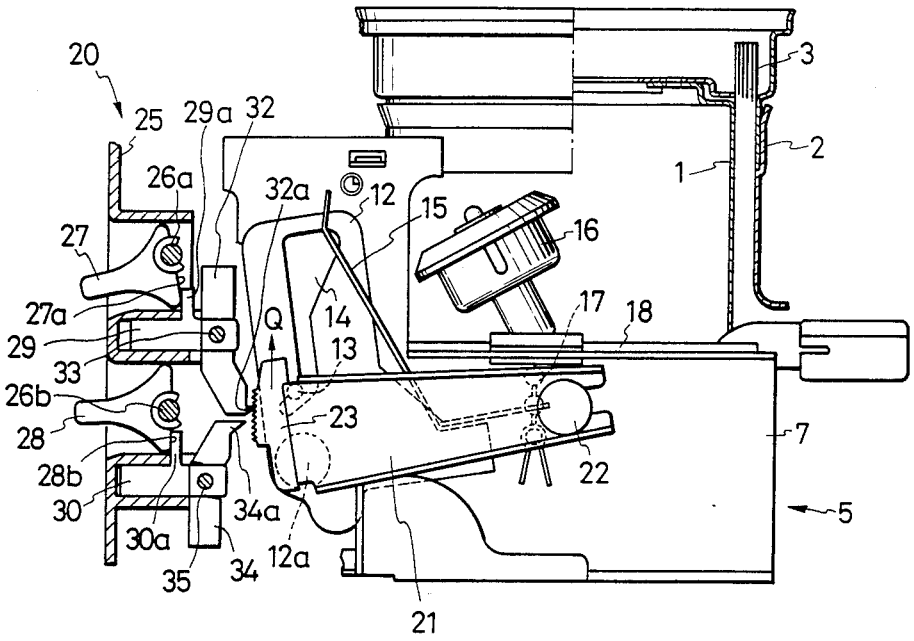
FIG. 9 is a side elevational and partially sectional view of the fine-regulatable raising and lowering mechanism showing the condition when an anti-earthquake extinguishing mechanism operates during the raising of the wick.
Figure 10A:
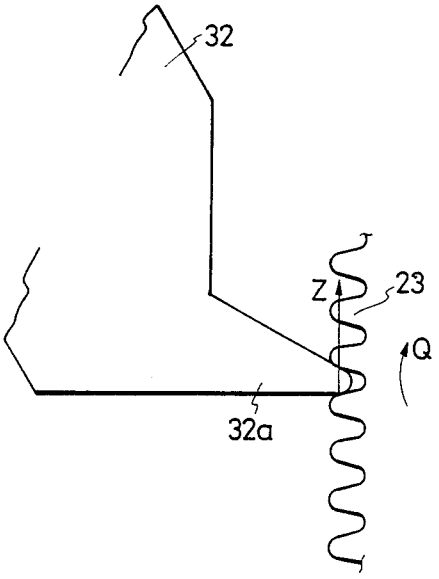
FIG. 10A is a fragmentary enlarged view of a taper portion having an undesirable configuration of a pinion in FIG. 9 for better understanding of the present invention.
Figure 10B:
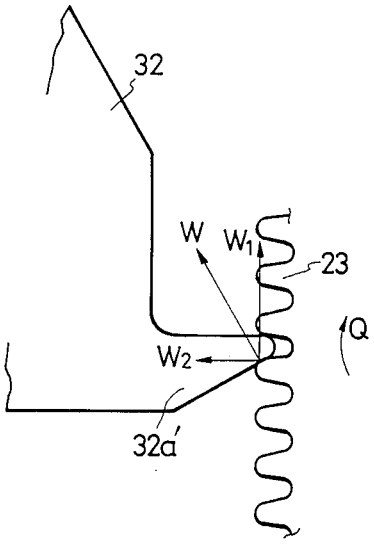
FIG. 10B is a fragmentary enlarged view of a taper portion having a desirable configuration of a pinion in FIG. 9.

FIG. 9 is a side elevational and partially sectional view of the fine-regulatable raising and lowering mechanism 20 showing the condition when an anti-earthquake extinguishing mechanism operates during a raising-operation of the wick 3. FIGS. 10A and 10B respectively show an example of the configuration of the taper portion of the wick-raising pinion 32. As mentioned above, when the weight 16 is swung, the lock pin 13 is returned to the upper portion of the slit 14 of the lock plate 12 by the biased force of the spring 11 (see also FIGS. 1 and 2). Therefore, the rack 23 is moved in the direction to an arrow Q. However, if the wick-raising pinion 32 is engaged with the rack 23, the rack 23 cannot be moved. At this time, as shown in FIG. 10A, if the lower edge of the taper portion 32*a* of the wick-raising pinion 32 is made the right angle with a locus of the rack 23, a force Z is effected to the wick-raising pinion 32. It means that the wick-raising pinion 32 will not easily slip from the rack 23.

Meanwhile, as shown in FIG. 10B, if a surface 32*a*'-which is forced by one of the teeth of the rack 23 when the rack 23 is raised because of accidental movement is made an acute angle with a face determined by a locus of the rack 23, a force W which is formed by W1 and W2 is effected to the surface 32*a*'. It means that the wick-raising pinion 32 can be easily slipped from the rack 23. Here, although the configuration of the wick-raising pinion 32 is described, the wick-lowering pinion 34 also has the same configuration of the taper portion as the wick-raising pinion 32. As a result, when such an accidental movement occurs, the which 3 is always extinguished. In addition, even if the emergency extinguishing pushbutton is pushed by a user during operation of the fine-regulatable wick raising and lowering mechanism 20, the extinguishment is safely performed. As will be seen from the above, the manually operable wick raising and lowering lever 6 is connected with such an anti-earthquake extinguishing mechanism for moving the wick downward in the event of accidental movement thereof.

Besides, the rack 23 has teeth whose number is a number required for driving the wick raising and lowering lever 6 by an extent that the wick 3 is normally combusted, i.e. an extent that exhaust characteristics of $CO/CO_2$ meets a standard requirement. More specifically, as shown in FIG. 5, the normal combustion extent of the wick 3 is determined by the uppermost portion 23*b* to the lowermost portion 23*a* of the teeth of the rack 23.

In addition, since the wick 3 has a tare weight, it is required that the operational force of the first manually operable member 27 be stronger than the operational force of the second manually operable member 28. Therefore, there is a disadvantage that operational feeling cannot be satisfied. In order to resolve such a problem, in this embodiment, the force of the slidable member returning spring 38 biasing the second slidable member 30 in the opposite direction to the rack 23 is stronger than the force of the slidable member returning spring 36 biasing the first slidable member 29 in the opposite direction the rack 23. Namely, the operational force of the first manually operable member 27 can be equalized to the operational force of the second manually operable member 28 whereby a satisfactory operational feeling is obtained.

Figure 11:
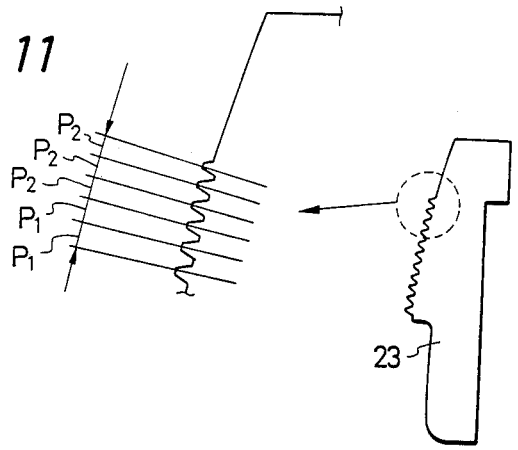
FIG. 11 shows a condition of arranged teeth of the rack according to the first embodiment.

The condition of arranged teeth of the rack 23 will be described hereinbelow. Referring now to FIG. 6, assuming the rack 23 has only one pitch, when the rack 23 is raised, a backlash of the teeth of the rack 23 becomes large at the upper portion of the rack 23 in the direction to an arrow L whereby the wick-raising pinion 32 cannot be precisely engaged with the rack 23. Therefore, there is a drawback that the backlash causes unsatisfactory movement of the rack 23. As shown in FIG. 11, in the present invention, the rack 23 has teeth in which a pitch P2 of at least two teeth arranged from a side near the wick-raising pinion 32 is narrower than another pitch P1 of remaining teeth. In this embodiment, each pitch of four teeth is P2, and is narrower than the other pitch P1 to avoid the unsatisfactory movement of by the backlash. As a result, the rack 23 can be certainly moved between both ends of the teeth.

Figure 12:
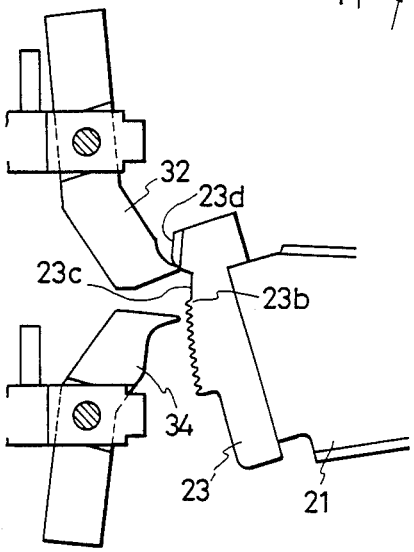
FIG. 12 shows a rack of another embodiment of FIG. 11.

In addition, as shown in FIG. 12, a rack 23' has a non-tooth portion 23*c* at a side near the wick-raising pinion 32 and a projection 23*d* at an end near the wick-raising pinion 32 for limiting an upward movement of the rack 23' whereby a wick uppermost position determined by an operation of the wick-raising pinion 32 is lower than a wick uppermost position determined by an operation of the manually operable wick raising and lowering lever 6. Therefore, the wick 3 can be safely regulated without a large flame of the wick 3 even if the the wick 3 is continuously raised up to the wick uppermost position by operating the fine-operable wick raising and lowering mechanism 20.

Figure 13:
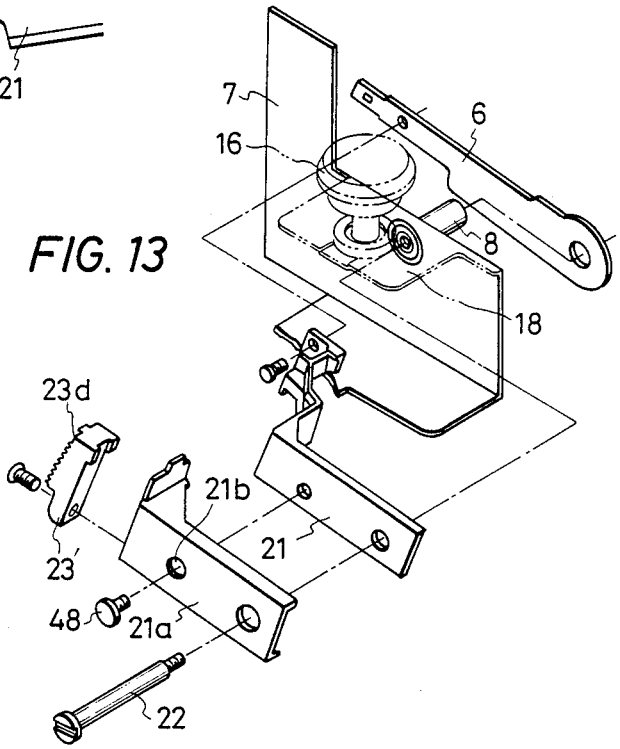
FIG. 13 is an exploded oblique view of essential components of the apparatus for raising and lowering the wick according to a second embodiment of the present invention.
Figure 14:
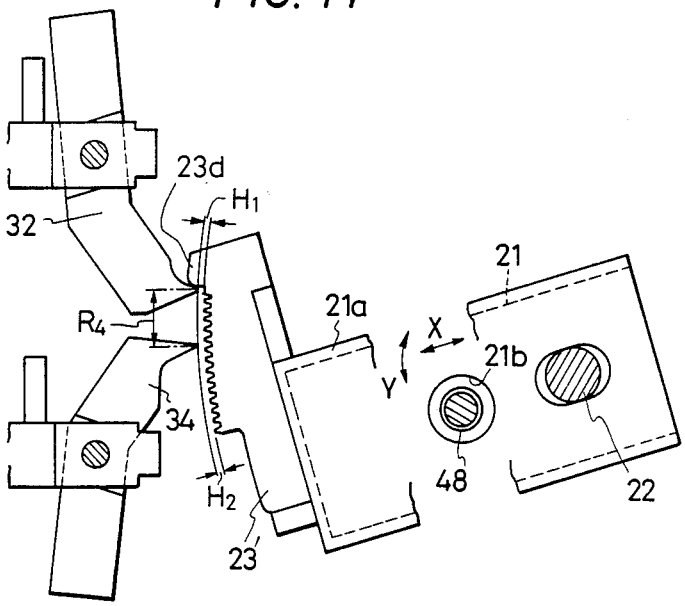
FIG. 14 side elevational view for describing the operation of the apparatus for raising and lowering the wick according to the second embodiment.

Next, the second embodiment of the present invention will be described hereinbelow. Referring now to FIGS. 13 and 14, a kerosene heater wick raising and lowering mechanism 5 according to the second embodiment has the same structure as the above-mentioned first embodiment except that an auxiliary lever member 21*a* having a through hole 21*b* is adjustably provided to the sub-lever 21 fixed to the manually operable wick raising and lowering lever 6 by means of a screw 48 whose diameter is narrower than the through hole 21*b*, and that rack 23 is fixed to the auxiliary lever member 21*a*. In such structure of the second embodiment, a desirable relation between the wick-raising and lowering pinions 32 and 34 and the rack 23' can be obtained by adjusting the auxiliary lever member 21*a* in the direction to arrows X and Y as shown in FIG. 14. More specifically, since a pitch P4 between the wick-raising pinion 32 and the wick-lowering pinion is constant, when the wick 3 is hole 21*b*, and that rack 23 is fixed to the auxiliary lever member 21*a*. In such structure os the second embodiment, a desirable relation between the wick-raising and lowering pinions 32 and 34 and the rack 23' can be obtained by adjusting the auxiliary lever member 21*a* in the direction to arrows X and Y as shown in FIG. 14. More specifically, since a pitch P4 between the wick-raising pinion 32 and the wick-lowering pinion 34 is constant, when the wick 3 is raised up to the uppermost position, the wick-lowering pinion 34 can be always positioned to a constant position by adjusting the position of the auxiliary lever member 21 such that the taper portion of the wick-raising pinion 32 just hits the projection 23*d* of the rack 23'. Besides, desired distances H1 and H2 between the locus of the teeth of the rack 23' and the respective positions of the wick-raising and lowering pinions 32 and 34 can be obtained by adjusting the auxiliary lever member 21*a* in the X-direction so as to equalize H1 to H2. Thus, in the second embodiment structure, the relation between the rack 23' and the wick-raising and lowering pinions 32 and 34 can be correctly adjusted by means of the auxiliary lever member 21*a*.

Figure 15:
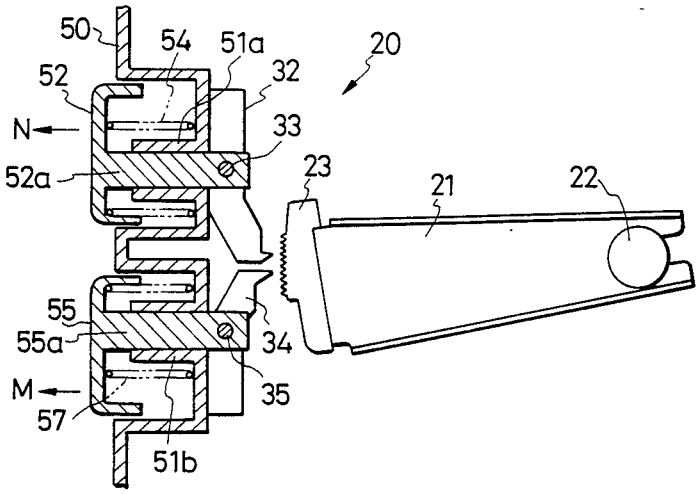
FIG. 15 is a side elevational and partially sectional view of the apparatus for raising and lowering the wick according to a third embodiment of the present invention.

The third embodiment of the present invention will be described hereinbelow. Referring to FIG. 15, essential parts of a kerosene heater wick raising and lowering mechanism 5 according to the third embodiment has the same structure as the first embodiment except that the wick-raising pinion 32 is driven by a manually operable sliding member 52*a*, and that the wick-lowering pinion 34 is driven by a manually operable sliding member 55*a*. Owing to this, a base body 50 is different from the base body 25, and a sliding member supporting portion 51*a* and a sliding member supporting portion 55*a* are provided thereto. In addition, a first manually operable portion 52 and the slidable member 52*a* are formed as one body, and a second manually operable member 55 and the slidable member 55*a* are also formed as one body. Moreover, the slidable members 51*a* and 55*a* is respectively biased by respective springs 54 and 57 in the opposite direction to the rack 23. Therefore, the first manually operable portion 52 is forced in the direction to an arrow N, and the second manually operable portion 55 is forced in the direction to an arrow M. In the third embodiment, since the manually operable members 52 and 55 and the sliding members 52*a* and 55*a* are formed as one body, the structure becomes simple in comparison with the same features of the first and second embodiments.

Figure 16:
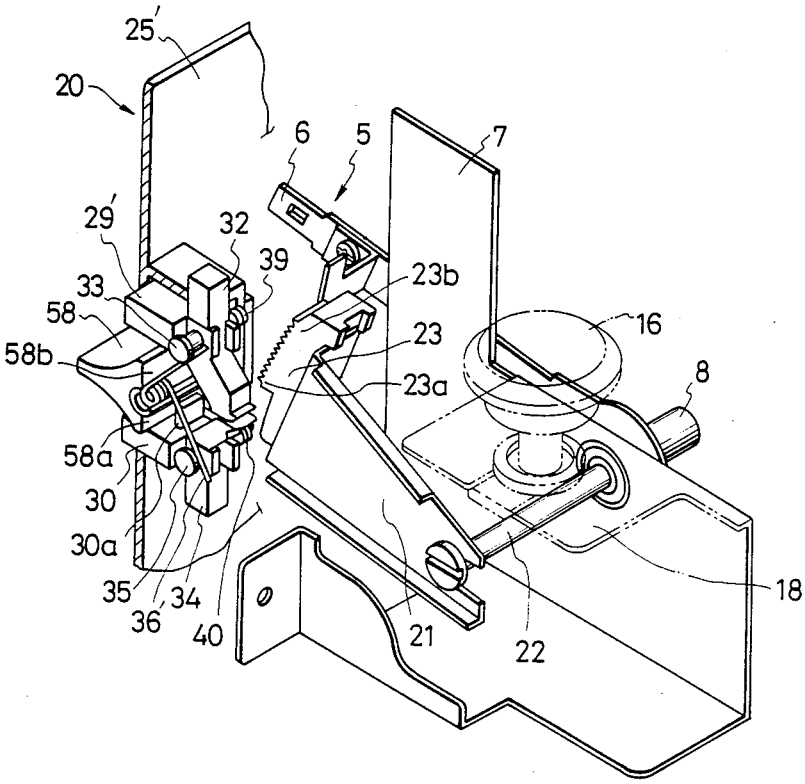
FIG. 16 is an oblique view of an essential components of the apparatus for raising and lowering the wick according to a fourth embodiment of the present invention.
Figure 17:
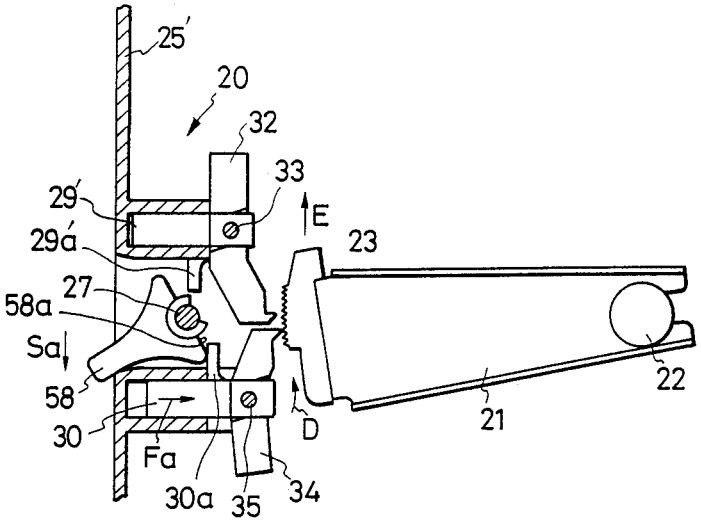
FIG. 17 is a side elevational and partially sectional view of the apparatus for raising and lowering the wick according to the fourth embodiment showing the condition during the lowering of the wick.
Figure 18:
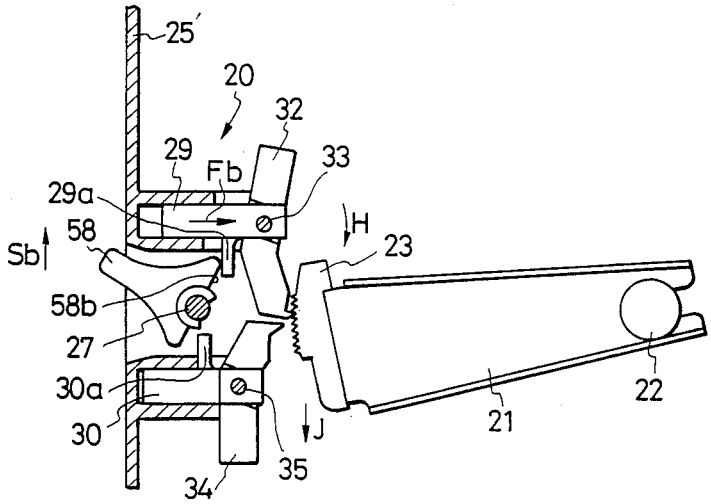
FIG. 18 is a side elevational and partially sectional view of the apparatus for raising and lowering the wick according to the fourth embodiment showing the condition during the raising of the wick.

Finally, the fourth embodiment of the present invention will be described hereinbelow with reference to FIGS. 16 through 18. A kerosene heater wick raising and lowering mechanism according to the fourth embodiment has the same structure as the above-mentioned first embodiment except that the wick-raising pinion 32 and the wick-lowering pinion 34 are driven by only a manually operable member 58 having a hitting surface 58*a* and a hitting surface 58*b*. In order to achieve such an operation, a first manually operable member 29' has a projection 29*a'* at the lower surface of the first manually operable member 29', and a base body 25' is different from the base body 25 in the first embodiment. In addition, the first slidable member 29' and the second slidable member 30 are biased in the opposite direction to the rack 23 by means of only a spring 36'. FIG. 17 is a side elevational and partially sectional view of the fourth embodiment showing the condition during the lowering of the wick 3, and FIG. 18 is a side elevational and partially sectional view of the fourth embodiment showing the condition during the raising of the wick 3. As shown in FIG. 17, when the wick 3 is lowered, the manually operable member 58 is moved in the direction to an arrow Sa, then the projection 30*a* is hit by the hitting surface 58*a* to push the projection 30*a* in the direction to an arrow Fa. Therefore, the wick-lowering pinion 34 is engaged with the rack 23, and the wick-lowering pinion 34 is rotated in the direction to an arrow D whereby the rack 23 is moved in the direction to an arrow E to render the wick 3 movable downward. On the contrary, as shown in FIG. 18, when the wick 3 is raised, the manually operable member 58 is moved in the direction to an arrow Sb, then the projection 29*a* is hit by the hitting surface 58*b* to push the projection 29*a* in the direction to an arrow Fb. Therefore, the wick-raising pinion 32 is engaged with the rack 23, and the wick-raising pinion 32 is rotated in the direction to an arrow H whereby the rack 23 is moved in the direction to an arrow J to render the wick 3 movable upward.

Figure 19:
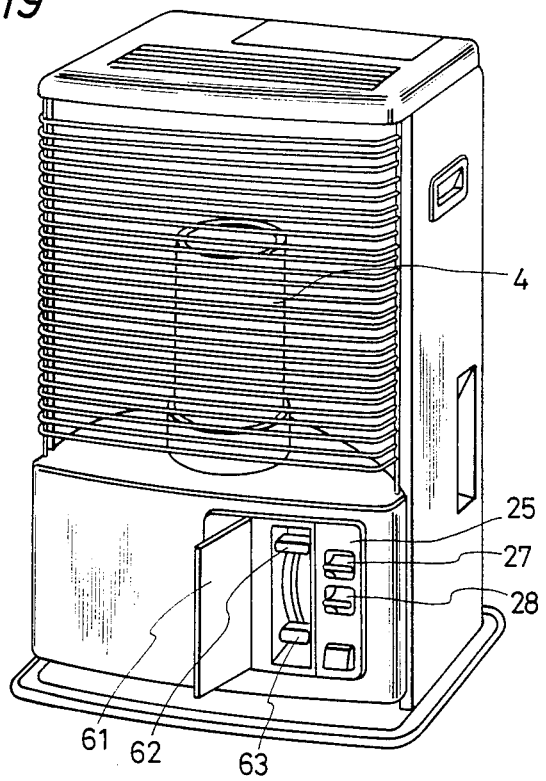
FIG. 19 is a kerosene heater to which the present invention is applied.

FIG. 19 shows one example of the kerosene heater to which the kerosene heater wick raising and lowering mechanism 5 according to the first embodiment is applied. A reference numeral 62 denotes an igniting operation knob which is provided to the igniting lever 9, and a reference numeral 63 shows a wick raising and lowering knob which is provided to the manually operable wick raising and lowering lever 6. In this kerosene heater, after a door 61 is opened, then the wick raising and lowering knob 63 is moved downward to raise the wick 3. Subsequently, the igniting operation knob 62 is moved downward to ignite the wick 3. As will be understood from the above description, the combustion rate can be finely regulated by the first manually operable member 27 and the second manually operable member 28.

As will be seen from the above description, in apparatus for raising and lowering the wick, a fuel combustion rate responding to wick height can be easily, finely, and safely regulated by means of the rack 23 and pinions 32 and 34 of the fine-regulatable wick raising and lowering mechanism 20. It is to be noted that the above-mentioned embodiments can be combined each other for achieving the objects of the present invention.

The above-described embodiments are just examples of the present invention, and therefore, it will be apparent for those skilled in the art that many modifications and variations may be made without departing from the scope of the present invention.

What is claimed is:

1. Apparatus for raising and lowering a wick of a kerosene heater, comprising:

(a) a wick raising and lowering means having means for supporting said wick, and a manually operable wick raising and lowering lever for raising and lowering said means for supporting said wick; and (b) a fine-regulatable wick raising and lowering means for finely controlling an angular position of said wick raising and lowering lever, including:

(i) a rack provided to said manually operable wick raising and lowering lever;

(ii) a wick-raising pinion pivotally provided to a first slidable member so that a portion of said wick-raising pinion is engageable to said rack;

(iii) a wick-lowering pinion second slidable member so that a portion of said wick-lowering pinion is engageable to said rack;

(iv) a first manually operable member for driving said first slidable member when moved in one direction whereby said wick-raising pinion is engaged with said rack to render said wick movable upward; and (v) a second manually operable member for driving said second slidable member when moved in one direction whereby said wick-lowering pinion is engaged with said rack to render said wick movably downward.

2. Apparatus for raising and lowering a wick of a kerosene heater, comprising:

(a) a wick raising and lowering means having means for supporting said wick and a manually operable wick raising and lowering lever for raising and lowering said means for supporting said wick; and (b) a fine-regulatable wick raising and lowering means for finely controlling an angular position of said wick raising and lowering lever, including:

(i) a rack provided to said manually operable wick raising and lowering lever;

(ii) a wick-raising pinion pivotally provided to a first slidable member so that a portion of said wick-raising pinion is engageable to said rack;

(iii) a wick-lowering pinion second slidable member so that a portion of said wick-lowering pinion is engageable to said rack; and (iv) a manually operable member for driving said first slidable member when moved in one direction whereby said wick-raising pinion is engaged with said rack to render said wick movably upward and for driving said second slidable member when moved in an opposite direction whereby said wick-lowering pinion is engaged with said rack to render said wick movable downward.

3. Apparatus for raising and lowering a wick of a kerosene heater, comprising:

(a) a wick raising and lowering means having means for supporting said wick and a manually operable wick raising and lowering lever for raising and lowering said means for supporting said wick; and (b) a fine-regulatable wick raising and lowering means for finely controlling an angular position of said wick raising and lowering lever, including:

(i) an auxiliary lever member adjustably provided to said manually operable wick raising and lowering lever;

(ii) a rack provided to said auxiliary lever member;

(iii) a wick-raising pinion pivotally provided to a first slidable member so that a portion of said wick-raising pinion is engageable to said rack;

(iv) a wick-lowering pinion second slidable member so that a portion of said wick-lowering pinion is engageable to said rack;

(v) a first manually operable member for driving said first slidable member when moved in one direction whereby said wick-raising pinion is engaged with said rack to render said wick movably upward; and (vi) a second manually operable member for driving said second slidable member when moved in one direction whereby said wick-lowering pinion is engaged with said rack to render said wick movably downward.

4. Apparatus for raising and lowering a wick of a kerosene heater, comprising:

(a) a wick raising and lowering means having means for supporting said wick and a manually operable wick raising and lowering lever for raising and lowering said means for supporting said wick; and (b) a fine-regulatable wick raising and lowering means for finely controlling an angular position of said wick raising and lowering lever, including:

(i) an auxiliary lever member adjustably provided to said manually operable wick raising and lowering lever;

(ii) a rack provided to said auxiliary lever;

(iii) a wick-raising pinion pivotally provided to a first slidable member so that a portion of said wick-raising pinion is engageable to said rack;

(iv) a wick-lowering pinion second slidable member so that a portion of said wick-lowering pinion is engageable to said rack; and (v) a manually operable member for driving said first slidable member when moved in one direction whereby said wick-raising pinion is engaged with said rack to render said wick movably upward and for driving said second slidable member when moved in an opposite direction whereby said wick-lowering pinion is engaged with said rack to render said wick movably downward.

5. Apparatus for raising and lowering a wick of a kerosene heater as claimed in any of claims 1 through 4, wherein said rack has teeth whose number is a number required for driving said wick raising and lowering lever by an extent that said wick is normally combusted.

6. Apparatus for raising and lowering a wick of a kerosene heater as claimed in any of claims 1 through 4, wherein said rack has teeth in which a pitch of at least two teeth arranged from a side near said wick-raising pinion is narrower than another pitch of remaining teeth.

7. Apparatus for raising and lowering a wick of a kerosene heater as claimed in any of claims 1 through 4, wherein said rack has a non-tooth portion at a side near said wick-raising pinion and a projection at an end near said wick-raising pinion for limitting an upward movement of said rack whereby a wick uppermost position determined by an operation of said wick-raising pinion is lower than a wick uppermost position determined by an operation of said manually operable wick raising and lowering lever.

8. Apparatus for raising and lowering a wick of a kerosene heater as claimed in any of Claims 1 through 4, wherein said rack is driven by said wick-raising and lowering pinions by one pitch in said rack.

9. Apparatus for raising and lowering a wick of a kerosene heater as claimed in any of Claims 1 through 4, wherein said manually operable wick raising and lowering lever is connected with a displaying means for displaying a fuel consumption rate.

10. Apparatus for raising and lowering a wick of a kerosene heater as claimed in one of Claims 1 and 3, wherein said first slidable member is biased by a first spring member in the opposite direction to said rack and said second slidable member is biased by a second spring member in the opposite direction to said rack so that said second spring is stronger than said first spring.

11. Apparatus for raising and lowering a wick of a kerosene heater as claimed in any of Claims 1 through 4, further comprising an anti-earthquake extinguishing means connected with said manually operable wick raising and lowering lever for moving said wick downward in the event of accidental movement thereof.

12. Apparatus for raising and lowering a wick of a kerosene heater as claimed in any of Claims 1 through 4, wherein said wick-raising pinion has a taper portion in which a surface forced by one of teeth of said rack when said rack is raised by occurring an accidental movement, is made an acute angle with a face determined by a locus of the rack so as to easily slip from said rack when engaging, and said wick-lowering pinion has a taper portion in which a surface forced by one of teeth of said rack when said rack is raised by an accidental movement is made an acute angle with a face determined by a locus of the rack so as to easily slip from said rack when engaging.

* * * * *